US005752384A

United States Patent [19]

Schmitt et al.

[11] Patent Number: 5,752,384

[45] Date of Patent: May 19, 1998

[54] CONTROL ARRANGEMENT FOR AT LEAST TWO HYDRAULIC CONSUMERS

[75] Inventors: Martin Schmitt, Goldbach; Thomas Weickert, Karsbach-Hessdorf, both of Germany

[73] Assignee: Mannesmann Rexroth AG, Lohr/Main, Germany

[21] Appl. No.: 750,318

[22] PCT Filed: Apr. 29, 1995

[86] PCT No.: PCT/EP95/01642

§ 371 Date: Nov. 20, 1996

§ 102(e) Date: Nov. 20, 1996

[87] PCT Pub. No.: WO95/32364

PCT Pub. Date: Nov. 30, 1995

[30] Foreign Application Priority Data

May 21, 1994 [DE] Germany ..... 44 17 962.6

[51] Int. Cl.[6] ..... F16D 31/02

[52] U.S. Cl. ..... 60/426; 60/452; 91/447

[58] Field of Search ..... 60/426, 445, 452; 91/446, 447

[56] References Cited

U.S. PATENT DOCUMENTS

| | | | |
|---|---|---|---|
| 4,938,023 | 7/1990 | Yoshino | 60/452 |
| 5,305,789 | 4/1994 | Rivolier | 60/452 |
| 5,347,811 | 9/1994 | Hasegawa et al. | 91/446 |
| 5,460,000 | 10/1995 | Kropp | 60/452 |

FOREIGN PATENT DOCUMENTS

| | | |
|---|---|---|
| 0053323 | 6/1982 | European Pat. Off. . |
| 0566449 | 10/1993 | European Pat. Off. . |
| 3540061 | 5/1987 | Germany . |
| 3603630 | 8/1987 | Germany . |
| 3805061 | 8/1989 | Germany . |
| 3812753 | 10/1989 | Germany . |
| 3919175 | 12/1990 | Germany . |
| 4135013 | 4/1993 | Germany . |
| 4137963 | 5/1993 | Germany . |
| 9318522 | 3/1995 | Germany . |

OTHER PUBLICATIONS

N.N.: An Den Bedarf Anpassen In: fluid, Oct. 1988 pp. 18, 23, 24.

*Primary Examiner*—F. Daniel Lopez
*Attorney, Agent, or Firm*—Martin A. Farber

[57] ABSTRACT

The present invention proceeds from a control arrangement for at least two hydraulic consumers which has a positive displacement pump the setting of which is variable by a load-sensing regulator which can be acted on via a load-signaling line by the highest load pressure, on which a maximum-pressure and an output regulation are superimposed, two displaceable metering diaphragms a first one of which is connected between the positive displacement pump and a first hydraulic consumer and the second between the positive displacement pump and a second hydraulic consumer, and two pressure compensators a first one of which is arranged behind the first metering diaphragm and the second behind the second metering diaphragm and the regulating pistons of which can be acted on, in opening direction on a front side, by the pressure behind the corresponding metering diaphragm and in closing direction on the rear side by the pressure in the load-signaling line. In order that the pump pressure does not become maximum, since, upon simultaneous actuation of the two hydraulic consumers, the one consumer is moved against a stop or carries out a clamping function, it is provided that, in the event of such joint control of only the first and the second hydraulic consumers, the load-sensing regulator as from a limiting pressure which lies below the maximum pressure can be acted on by a pressure which is dependent only on the load pressure of the one first hydraulic consumer.

25 Claims, 5 Drawing Sheets

CONTROL ARRANGEMENT FOR AT LEAST TWO HYDRAULIC CONSUMERS

FIELD AND BACKGROUND OF THE INVENTION

The present invention is based on a control arrangement or system for at least two hydraulic consumers having a positive displacement pump which is adjusted by a load-sensing regulator responsive to a load-signaling line with the highest load pressure of the plural consumers, on which there are superimposed a maximum-pressure and an output regulation. The system includes two displaceable metering throttles, the first of which is connected between the positive displacement pump and a first hydraulic consumer and the second of which is connected betweeen the positive displacement pump and a second hydraulic consumer. The system further comprises two pressure compensators, the first one of which is connected behind the first metering throttle and the second of which is connected behind the second metering throttle and, wherein, regulating pistons of the compensators are activated on a front side by the pressure behind the corresponding metering throttle in an opening direction and on a rear side of the piston by the pressure in the load-signaling line in the closing direction.

Such a control arrangement is known from EP 0 566 449 A1. It comprises a positive displacement pump which can be so adjusted as to produce at its output a pressure which lies a given amount above the highest load pressure of all hydraulic consumers. A load-sensing regulator is present for this so-called load-sensing regulation which can be acted on by the pump pressure for a reduction of the displacement volume of the positive displacement pump and by the highest load pressure and a compression spring for an increase in the displacement volume of the pump. The difference between the pump pressure and the highest load pressure corresponds to the force of this compression spring.

The pressure compensator which is arranged downstream of each displaceable metering diaphragm maintains the pressure drop over the metering diaphragm constant so that the amount of pressurized fluid flowing to a hydraulic consumer is dependent solely on the opening cross section of the metering diaphragm and not on the load pressure of the consumer or on the pump pressure. At the same time, by means of the pressure compensators, the result is obtained that, in a case in which the hydraulic pump has been displaced up to the maximum displacement volume and the stream of pressurized fluid is not sufficient to maintain the pre-established pressure drop over the metering diaphragms, the pressure compensators of all actuated hydraulic consumers are displaced in closing direction so that all streams of pressurized fluid to the individual loads are reduced by the same percentage. On the basis of this load-independent distribution of flow, all actuated consumers move with a speed which is reduced percentually by the same value.

A load-sensing-regulated variable displacement pump is ordinarily equipped also with a pressure regulation by which the maximum possible pump pressure is pre-established, and with an output regulation which determines the maximum output which can be provided by the pump. Pressure regulation and output regulation are superimposed on the load-sensing regulation.

With a control arrangement of the type described, the following manner of actuation of two hydraulic consumers is now possible. The one hydraulic consumer is moved up to a stop and is to be held against this stop. For instance, a clamp which clamps an object fast between its jaws can be moved by the consumer. After the clamping fast of the object, another hydraulic consumer is actuated in order to move the object from one place to another. The two hydraulic consumers can be present, for instance, on a mobile working machine, in particular an excavator. Upon the clamping fast of the object, a pressure builds up on the corresponding hydraulic consumer, this pressure corresponding to the maximum pressure predetermined by the pressure regulation. Because of this high pressure, the output regulation of the variable displacement pump responds even in the case of a small amount of pressurized fluid flowing to the other hydraulic consumer, so that said other hydraulic consumer can be moved only with a low speed.

SUMMARY OF THE INVENTION

It is the object of the invention so further to develop a control system having the foregoing features so that rapid movement is possible for a first hydraulic consumer even when a second hydraulic consumer is moved against a stop and is to be held fast against this stop.

This object is achieved in accordance with the invention by providing the control system with a load sensing regulator wherein, upon joint actuation of the consumers, the regulator under a condition of a limiting pressure lying below a maximum pressure is responsive to the pressure dependent only on a load pressure of a first of the consumers. The load-sensing regulator can, in case of joint control only of the first and the second hydraulic consumers be acted on as from a limiting pressure lying below the maximum pressure by a pressure which is dependent only on the load pressure of the one first hydraulic consumer.

The invention is based, first of all on the concept that the maximum pressure is not necessary in order to hold the second consumer against the stop or to produce the necessary clamping force with the second consumer. In accordance with the invention, therefore, a limiting pressure is pre-established below which the pressure in the load-signaling line cannot lie when the second hydraulic consumer is actuated. This limit pressure is sufficient for a pump pressure which assures the dependable operation of the second hydraulic consumer to be produced by the pump. If the load pressure of the first hydraulic consumer lies above the limiting pressure, and if no third hydraulic consumer is actuated with a higher load pressure, then the pressure in the load-signalling line is dependent on the load pressure of the first hydraulic consumer. This load pressure normally lies below the maximum pressure set by the pressure regulation, so that the output regulation responds only with a flow of pressurized fluid much greater than at the maximum pressure.

Advantageous embodiments of a control arrangement in accordance with the invention can be noted herein.

In accordance with a feature of the invention, the load-sensing regulator in the case of an individual control of the second hydraulic consumer can be acted on even above the limiting pressure by the load pressure of the second consumer.

It is favorable if, aside from the first and second hydraulic consumers, a third hydraulic consumer can also be simultaneously be controlled. The control arrangement is therefore so developed, in accordance with a further feature, such that the load-sensing regulator can be acted on also as from the limiting pressure by the higher of the two load pressures of the first and third hydraulic consumers.

It is possible to permanently set the limiting pressure in a control arrangement in accordance with the invention.

However, it is more favorable to set a limiting pressure only in given situations. In accordance with FIG. 4, this is suitably done by a displaceable valve as a function of the position of which the load-sensing regulator can be acted on with different pressures. The valve can, for example, be displaceable intentionally by hand, depending upon which device is actuated with the second hydraulic consumer. If said consumer actuates, for instance, a shovel on an excavator, no limiting pressure may be provided. However, if instead of the shovel, a dump actuated by the second hydraulic consumer is mounted on the boom of an excavator, the limiting pressure may be active. Independently of or else depending on the device to be actuated by the second hydraulic consumer, it is favorable if, in accordance with yet another feather, the valve is displaceable as a function of different actuations of the hydraulic consumers. In the event of a joint control of the first hydraulic consumer and the second hydraulic consumer, the limiting value is active. In the case of a joint control of the first hydraulic consumer and a third hydraulic consumer, or in case of a joint control of the second hydraulic consumer and a third hydraulic consumer, the limiting pressure may not be provided.

Furthermore, the limiting pressure may advantageously be set on a pressure valve.

A particularly simple construction is possible by the use as pressure valve of a pressure-limiting valve by which the pressure in a rear pressure space of a load-signaling valve can be limited to the limiting pressure. This load-signaling valve is switched between the load-signaling line and a section of a consumer line which can be acted on by the load pressure of the first hydraulic consumer and has a control piston a rear pressure surface of which adjoins the rear pressure space and can be acted on by the pressure prevailing in said pressure space in closing direction and on a front pressure surface by the load pressure of the first hydraulic consumer in the opening direction. Furthermore, the rear pressure space is connected via a choke with the load-signaling line. The relatively simple construction results from the fact that the pressure-limiting valve is to be closed only at a bore hole in which the control piston of the load-signaling valve is contained and which is ordinarily accessible from the outside. This is clear also on basis of the directional control valves which are shown in EP 0 566 449 A1 and in the case of which a metering diaphragm, a load-signaling valve, a pressure compensator, two load-holding valves and a directional control are combined in a housing.

If a pressure-limiting valve is used in an arrangement in accordance with yet another feature, then the pump pressure lies in each case a given amount above the load pressure of the first hydraulic consumer when the pressure-limiting valve is active and when the load pressure is above the limiting pressure set by the pressure-limiting valve. The latter is ordinarily the case. As has been shown in tests, the pump pressure is also above the limiting pressure but below the maximum pressure when the load pressure of the first hydraulic consumer is less than the limiting pressure and when the load-signaling valves are combined with the pressure compensators in such a manner that the load-signaling line can be acted on via the control piston of the pressure compensator which is associated with the hydraulic load having this highest load pressure by said highest load pressure and when, therefore, a construction in accordance with EP 0 566 449 A1 is used.

One particularly advantageous further development of a control arrangement in accordance with the invention is characterized by the fact that the pump pressure can be limited by a pressure-reduction valve switched between the flow path to the second hydraulic load and the load-signaling line. This pressure-reduction valve sees to it that, with simultaneous control of the first and second hydraulic consumers, at least the limiting pressure prevails in the load-signaling line. On the other hand, it permits the load-signaling line to be acted on by a load pressure of the first hydraulic consumer or a third hydraulic consumer which lies above the limiting pressure. The pump pressure lies in each case above the pressure in the load-signaling line by the difference set on the load-sensing regulator.

In a first specific embodiment having a pressure-reduction valve, this valve can be arranged in series with the load-signaling valve of the second hydraulic consumer. If such a series connection is difficult structurally to produce, it is then more favorable to arrange the load-signaling valve and the pressure-reduction valve in parallel to each other and, for the entering into action of the pressure-reduction valve, to block the connection between a section of a consumer line which can be acted on by the load pressure of the second hydraulic consumer and the load-signaling line. This can be done, for instance, by a 2/2-directional cqntrol valve. However, it may also be favorable for the blocking to block a movable valve body of the load-signaling valve.

Several embodiments of a control arrangement in accordance with the invention are shown in the drawings.

BRIEF DESCRIPTION OF THE DRAWINGS

With the above and other advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
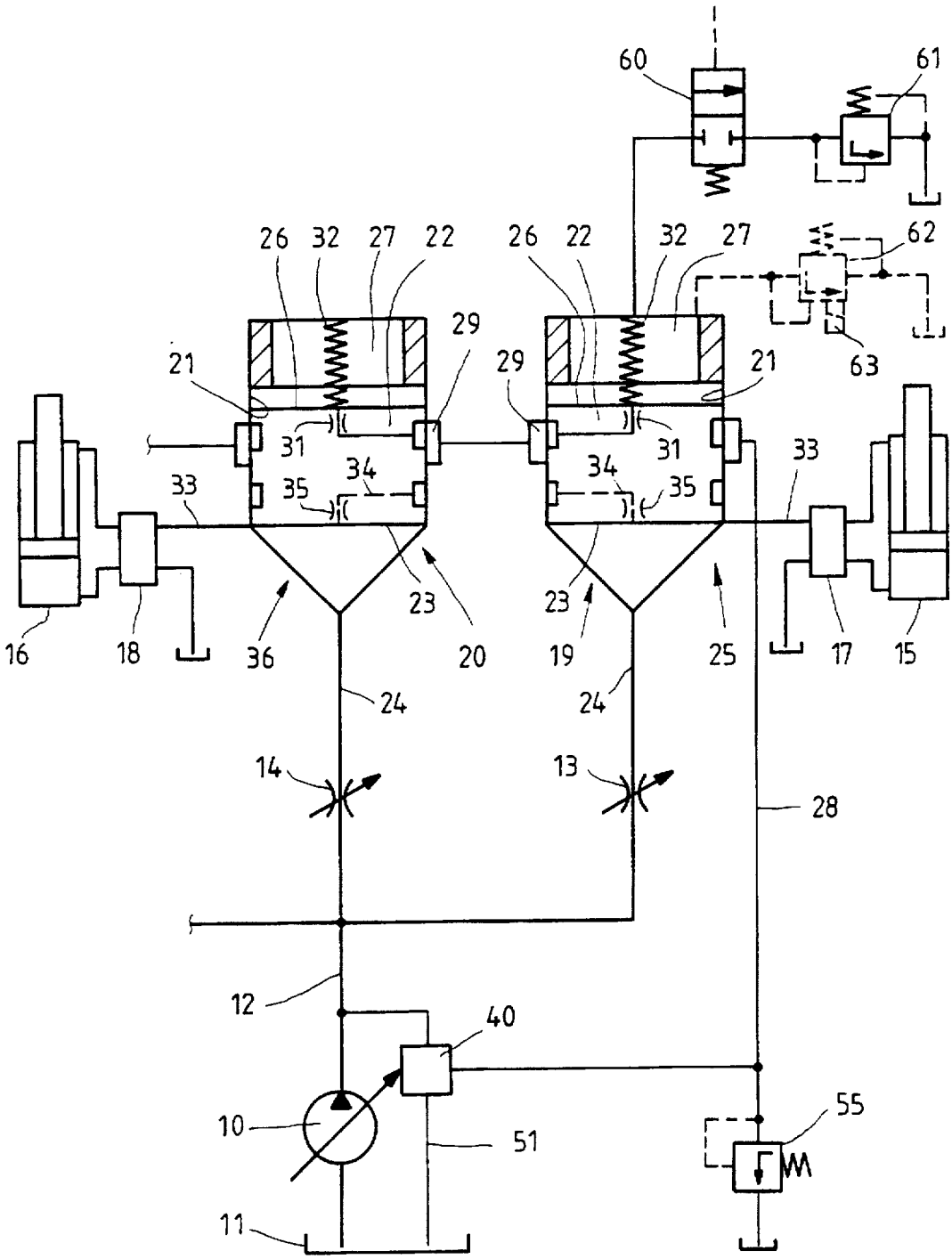
FIG. 1 shows a first control arrangement in which a limiting pressure can be set with a pressure-reducing valve.
Figure 2:
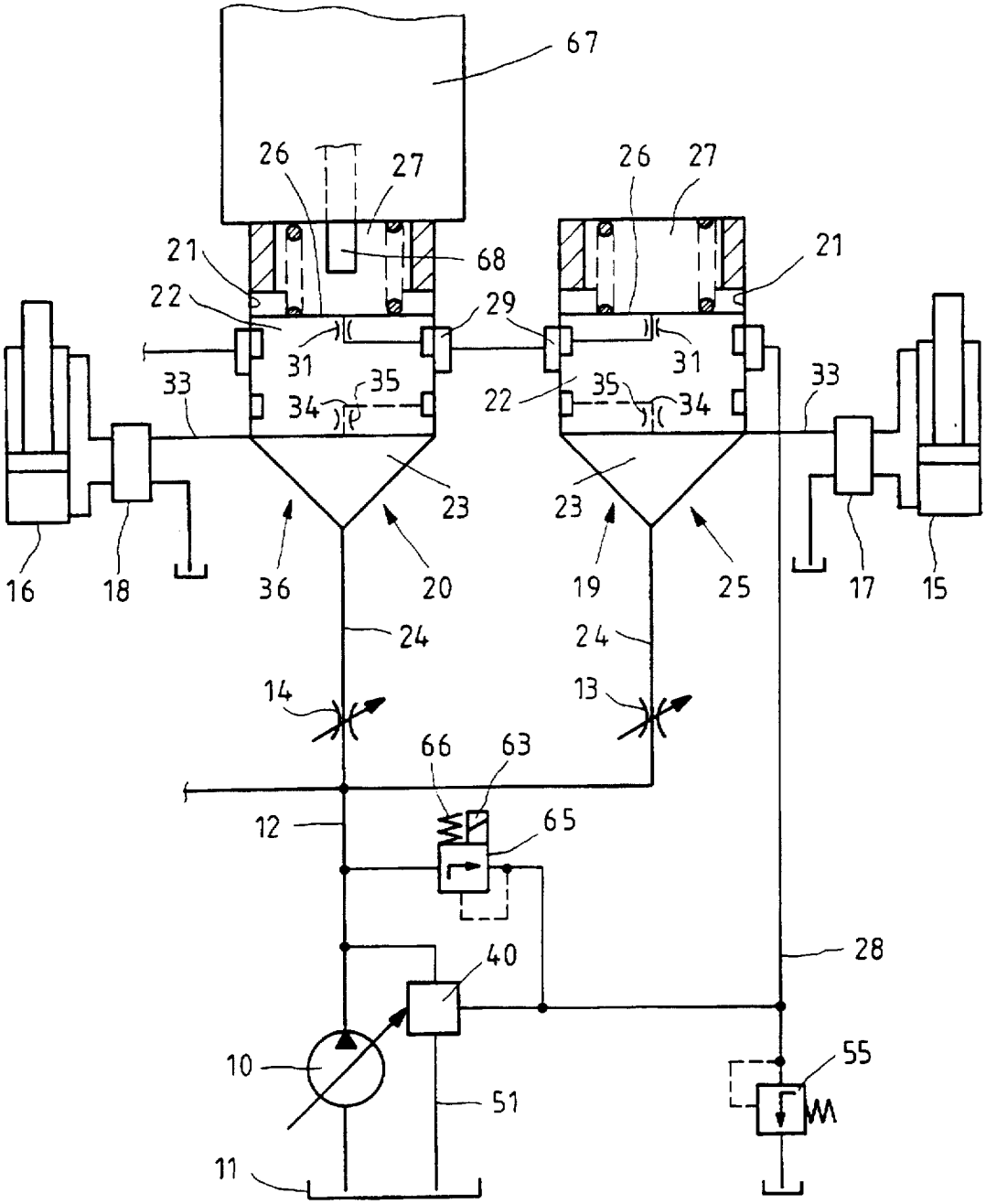
FIG. 2 shows a second control arrangement in which a limiting pressure can be set by a pressure-reduction valve which is arranged between the pressure connection of the positive displacement pump and the load-signaling line, and for the entering into action of which the control piston of a load-signaling valve can be blocked.

In the control arrangements shown in FIGS. 1 and 2, hydraulic oil can be drawn from a tank 11 by a hydraulic positive displacement pump 10 and delivered into a pressure line 12 to which a plurality of metering diaphragms are connected parallel to each other, a metering throttle 13 and a metering throttle 14 being shown in FIGS. 1 and 2. The metering throttle can be displaced independently of each other, directly by hand or by remote control, for instance electrically or electro-hydraulically. The metering throttle 13 is associated with a first hydraulic consumer 15 which is developed as a double-acting differential cylinder. The second metering throttle 14 is associated with a second hydraulic consumer 16, which is also a double-acting differential cylinder.

Each metering throttle 13 and 14 is the speed part of a proportional directional control valve which furthermore includes a directional part 17 and 18 respectively, arranged behind the metering diaphragm. Speed parts 13 and 14 and directional parts 17 and 18 respectively are moved jointly and are developed on a single directional-valve slide, as can be noted from FIG. 5.

Between each metering throttle 13 and 14 and the corresponding directional part 17 and 18 respectively, there is a 2-way pressure compensator 19, 20 which has a regulating piston 27 which is movable in a bore hole 21. The piston is acted on in opening direction of the pressure compensator on its front side 23 by the pressure which prevails behind the metering throttle 13, 14 in a section 24 of a channel 25, 36 respectively leading from the metering diaphragm to the directional part. By its rear face 26, which is of precisely the same size as the front face 23, the regulating piston 22 adjoins a rear pressure space 27 which is permanently connected with a load-signaling line 28 regardless of the position at the time of the regulating piston 22. The load-signaling line 28 connects together all bore holes 21 into which, as in the embodiments of FIGS. 1 and 2, it debouches in an annular groove 29 or, as in the embodiment of FIG. 5 in which the regulating piston of the pressure compensator is contained in a sleeve which is additionally inserted into a housing of the directional control valve, into several bore holes 30. The connection between the annular groove 29 or the bore holes 30 and the rear pressure space 27 is produced via the regulating piston 22, a throttle 31 the cross section of which is about 0.5 $mm^2$ being present in the connection.

The regulating piston 22 of a pressure compensator 19, 20 can assume two end positions, in which connection in the one end position which is shown in FIGS. 1 and 2 and which is established by a weakly prestressed compression spring 32 present in the pressure space 37, a connection between the section 24 and a section 33 of the channel 25, 26 present between the pressure compensator 19, 20 and the directional part 17, 18 respectively is interrupted. In the other end position of the regulating piston 22 of a pressure compensator 19, 20, the connection between the channel sections 24 and 23 is entirely open and the section 24 of the channel 25, 36 is connected with the load-signaling line 28 via bore holes 34, 35 in the regulating piston. In the connection, the bore hole 35 serves as a throttle which is arranged in the regulating piston, the opening cross section of which throttle is substantially greater than that of the throttle 31.

Figure 4:
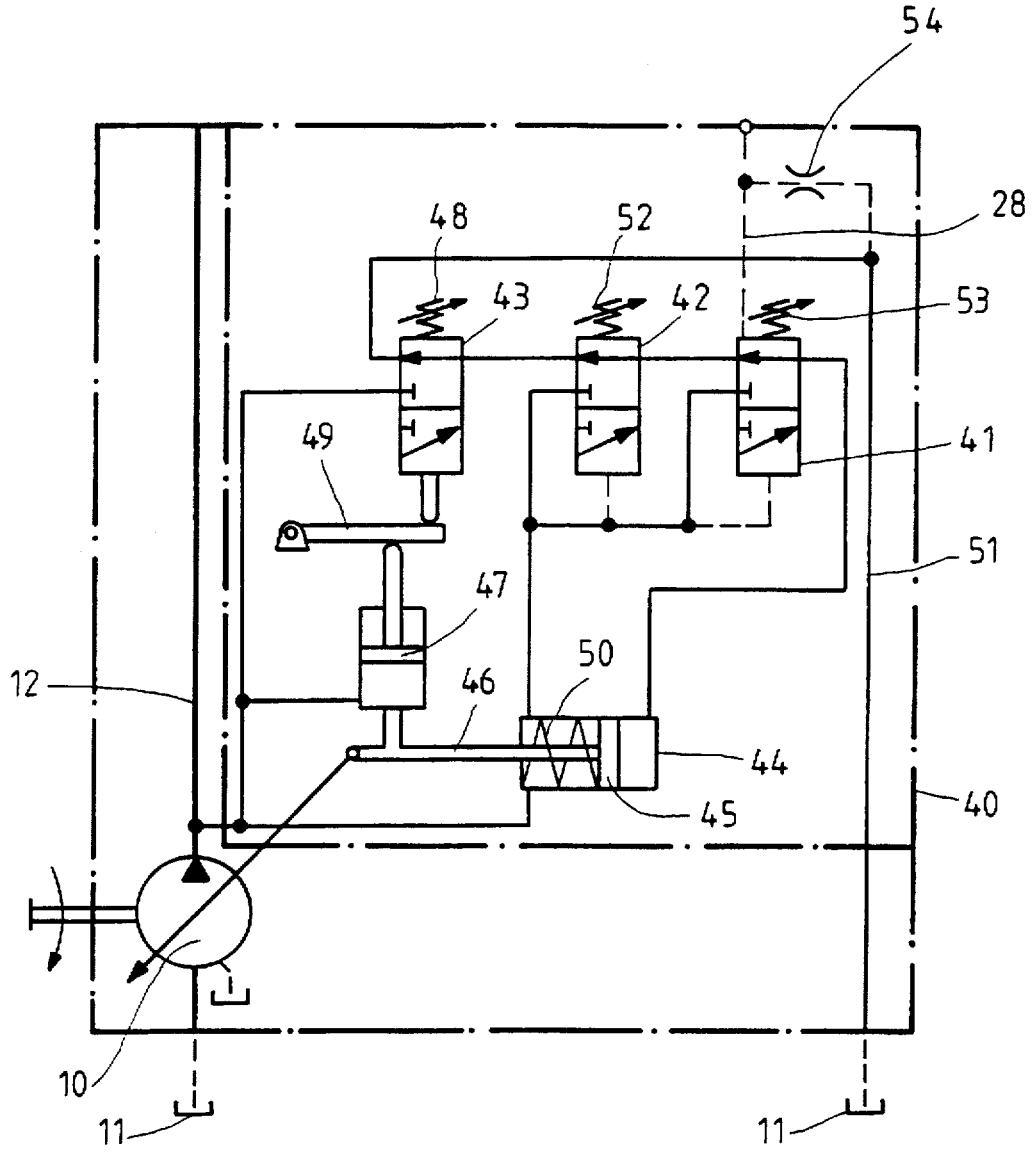
FIG. 4 shows the positive displacement pump of the three control arrangements shown, with three regulating devices constructed thereon.

The load-signaling line 28 leads to a regulating unit 40 which is built on the positive-displacement pump 10. This regulating unit 40 is known per se and is shown in further detail in FIG. 4. It comprises three 3/2-proportional directional control valves 41, 42 and 43. The pump 10 is displaced finally by a setting cylinder 44 having a setting piston 45 which is provided on one side with a piston rod 46. In the piston rod there is arranged a measurement piston 47 which acts, against the force of a compression spring 48, on a single-arm lever 49. The active lever length for the force of the compression spring is constant, while the active lever length for the force of the measurement piston 47 is dependent on the angle of swing of the pump 10. The measurement piston is acted on by the pump pressure. The pump pressure prevails also in a pressure space on the piston-rod side of the setting cylinder 44 within which space a compression spring 50 is arranged which acts on the setting piston 45 in the direction towards enlargement of the angle of swing of the pump 10. The valve 43 serves for regulating the output of the positive displacement pump 10. It has a connection which is connected to the tank 11 via a line 51. Another connection is present on the delivery line 12. The third connection, which can be connected with the first or the second connection, is connected with a first connection of the valve 42 by which the pump pressure is limited to a maximum value. A second connection of the valve 42 is connected to the pressure line 12 via the pressure space on the piston-rod side of the setting cylinder 44. The third connection of the valve 42 can be connected with its first or second connection and is permanently connected with a connection of the so-called load-sensing valve 41. The latter has a second connection, which is permanently connected with the pressure line 12, and a third connection which is permanently connected with the pressure space on the piston-rod side of the setting cylinder 44 and can be connected to the first or the second connection. A slide, not shown in detail, of the valve 43 is pressed by the compression spring 48 against the lever 49 and acts to increase the angle of swing of the pump 10. A slide (not shown in detail) of the valve 42 is acted on by a compression spring 52 so as to enlarge the angle of swing and by the pump pressure so as to reduce the angle of swing of the pump 10. A slide (not shown in detail) of the load-sensing valve 41 is finally acted on in the direction of an increase of the angle of swing of the pump 10 by a compression spring 53 and the pressure prevailing in the load-signaling line 23 in the direction of reducing the angle of swing by the pump pressure. On the slide of the valve 41 a force equilibrium prevails when a difference which corresponds to the force qf the spring 53 is present between the pump pressure and the pressure in the load-signaling line 28. Ordinarily, the difference is about 20 bar. Equilibrium prevails on the slide of the valve 42 when the pump pressure produces a force which corresponds to the force of the spring 52. Ordinarily, in the case of equilibrium, the pump pressure is in the vicinity of 350 bar.

The load-signaling line 28 is connected to the tank line 51 via a nozzle 54. Furthermore, as can be noted from FIGS. 1 and 2, a pressure-limiting valve 55 is connected to the load-signaling line, the valve being set to a pressure which is below the maximum pressure set on the valve 42 by the amount by which the pump pressure and the pressure prevailing in the load-signaling line 28 differ upon equilibrium on the slide of the load-sensing valve 41.

In order to explain the manner of operation of a control arrangement in accordance with the FIGS. 1 and 2 in normal operation, let us assume that, first of all, the first hydraulic consumer 15 is to be actuated and that, for this purpose, the metering throttle 13 is opened to a greater or lesser amount and the directional part 17 has been displaced in accordance with the desired direction of movement of the consumer 15. The pressure compensator 19 opens completely so that the load pressure of the consumer 15 builds up in both sections 24 and 33 of the channel 25. This load pressure is signaled via the regulating piston 22 of the pressure compensator 19 into the load-signaling line 28 and, via the latter, acts on the slide of the load-sensing valve 41. There is thus established in the delivery line 12 a pump pressure which is higher than the load pressure of the consumer 15 by an amount which corresponds to the force of the compression spring 53. Regardless of the opening cross section of the metering diaphragm 13, the pressure drop over it is always the same and corresponds to the difference between the pump pressure and the load pressure of the consumer 15. Since the load pressure of the consumer 15 is present in the entire load-signaling line, it is also prevails in the rear pressure spaces 27 of the two pressure compensators 19 and 20.

In addition to the consumer 15, the second hydraulic consumer 16 can now also be actuated, in which connection let us assume first of all that the load pressure of the second hydraulic consumer 16 is less than the load pressure of the first consumer 15. The load pressure of the second hydraulic consumer can therefore not fully open the pressure compensator 20. Its regulating piston rather now assumes a regulating position in which the pressure which acts on its front end surface 23, if one disregards the force of the compression spring 32, is exactly as great as the pressure in the pressure space 27 and therefore corresponds to the load pressure of the first consumer 15, and in which there is no connection between the space in front of the end surface 23 and the load-signaling line 28. Thus the pressure drop over the measuring throttle 14 is precisely as great as over the measuring throttle 13. The pressure in the section 24 of the channel 36 drops via the pressure compensator 22 to the load pressure of the second hydraulic consumer 16.

On the other hand, if the load pressure of the second hydraulic consumer 16 is higher than the load pressure of the first hydraulic consumer 15, then, upon actuation of the second hydraulic consumer, the pressure compensator 20 opens completely so that the load pressure of the consumer 16 is present in front of the end 23 of this pressure compensator 20, the regulating piston of the pressure compensator 20 opens entirely, and the load pressure of the consumer 16 is signaled into the load-signaling line 28. The pump pressure increases until it lies above the load pressure of the consumer 16 by the value established on the valve 41. The regulating piston of the pressure compensator 19 is moved into its regulating position.

Thus, in each case the highest load pressure of an actuated hydraulic consumer is signaled in the load-signaling line 28. The pump 10 produces a pump pressure which is about 20 bar above said highest load pressure. If now, for instance, a clamping device by which an object is grasped is actuated by the consumer 16 and is then to be transported by actuation of another hydraulic consumer, the pump pressure would reach the maximum value set on the valve 42 so that, even with only a slight amount of feed, the output regulation of the pump would respond and only a low speed of the consumer 15 would be possible. In this case, the maximum pressure of, for instance, 350 bar is far above the pressure which is necessary for a firm clamping of the object to be transported, which, for instance, lies in the vicinity of 150 bar. In order that the pump pressure does not in such a case increase to the maximum pressure, it is now provided, in accordance with the invention, in the control arrangements shown that, upon a joint control of the first consumer 15 and the second consumer 16, which exercises a clamping function, the load-signaling line 28 is acted on, as from a limiting pressure lying below the maximum pressure, by a pressure which is dependent only on the load pressure of the first hydraulic consumer 15. For this purpose, in the case of the embodiment of FIG. 1, the rear pressure space 27 of the pressure compensator 19 can be connected via a 2/2-directional control valve 60 to a pressure-limiting valve 61 which is set to a fixed value of, for instance 150 bar. The directional control valve 60, in its position of rest, blocks the connection between the pressure space 27 and the pressure-limiting valve 61. In the other switch position in which it can be brought, for instance, by actuation with a control pressure, it establishes a connection between the pressure space 27 of the pressure compensator 19 and the input of the pressure-limiting valve 61. The directional control valve 60 is brought into its second switch position when the first consumer 15 and the second consumer 16 are actuated simultaneously. Ordinarily the load pressure of the first hydraulic consumer 15 lies above the value set on the pressure-limiting valve 61. In this case, the load pressure of the first hydraulic consumer is able to open the pressure compensator 23 completely and to hold its regulating piston 22 in its upper end position, shown in FIG. 1. Via the nozzle 35 there is a connection between the channel 25 and the load-signaling line 28. The pressure compensator 20 is also entirely open, since the pressure in the load-signaling line 28 prevails in its rear pressure space 27 and, since no pressurized fluid flows to the consumer 16, the front end 28 of the regulating piston of the pressure compensator 20 is acted on by the pump pressure. In addition to over the metering throttle 13, a small amount of pressurized fluid now flows over the throttle 35 of the pressure compensator 20, the load-signaling line 28, and the throttle 35 of the pressure compensator 19 to the first consumer 15. Between the two throttles 35, and therefore in the load-signaling line 28, a pressure is established which is 20 bar above the load pressure of the first hydraulic consumer 15. Via the throttle 31 of the pressure compensator 19, this pressure drops to the pressure set on the pressure-limiting valve 61 and prevailing in the pressure space 27 of the pressure compensator 19.

If the load pressure of the first hydraulic consumer 15 is lower than the pressure set on the pressure-limiting valve 61, then, as tests which were carried out have shown, a pressure which lies above that set on the pressure-limiting valve but is far below the maximum pressure also builds up in the load-signaling line 28.

As alternative to a valve combination which consists of a directional control valve and a permanently set pressure-limiting valve, a pressure-limiting valve which is displaceable, for instance, by an electromagnet can also be used in order to establish a limiting pressure in the pressure space 27 of the press ure compensator 19. This solution is shown as an alternative in FIG. 1. In this case, the pressure-limiting valve, which is now provided with the reference numeral 62, is so developed that, with the electromagnet disconnected, it is set to a value which lies above the operating pressures which occur and is shifted to a lower value of, for instance, 150 bar, by actuation of the electromagnet. It therefore ha s a so-called dropping characteristic. The force of the electromagnet supports the pressure force which seeks to open the pressure-limiting valve 62 against the force of a compression spring. The falling characteristic is favorable when the connect time of the electromagnet is shorter than the disconnect time. In the reverse case, the magnet is so arranged that it acts against the pressure force in the closing direction of the valve 62.

In the embodiment shown in FIG. 2, there is used for the establishing of a limiting pressure, not a pressure-limiting valve but a pressure-reduction valve 65 which can be built directly on the positive displacement pump 10 and the input of which is connected with the pressure line 12 and its output with the load-signaling line 28. A weak compression spring 66 acts on a valve body, not shown in detail, in the opening direction of the valve 65. Furthermore, the valve body can be acted on in the opening direction also by an electromagnet 63. When the electromagnet 63 is disconnected, a very small pressure in the load-signaling line 28 is sufficient to close the pressure-reduction valve 65. When the electromagnet 63 is connected, a pressure of, for instance, 150 bar in the load-signaling line is necessary in order to close the valve 65.

An additional electromagnet 67 is attached to the rear pressure space 27 of the pressure compensator 20 and can, by a ram 68, block the regulating piston 22 of the pressure compensator 20 in such a manner that, while the latter can open the connection between the sections 24 and 33 of the channel 36, it cannot open the connection between this channel and the load-signaling line 28. The regulating piston of the pressure compensator 20 is blocked when the magnet 67 is connected.

In normal operation, which has been described already above, the magnets 63 and 67 are disconnected. The pressure-reduction valve 65 is therefore closed already with a very small pressure in the load-signaling line 28 and is therefore practically without effect.

Let us now assume that both consumers 15 and 16 are actuated and both magnets 63 and 67 are connected. Let us assume that the load pressure of the first hydraulic consumer 15 is less than the limiting pressure of, for instance, 150 bar set on the pressure-reduction valve by means of the electromagnet 63. Thus, this pressure of 150 bar prevails in the load-signaling line 28 and in the pressure spaces 27 of the pressure compensator 19 and the pressure compensator 20 with the regulating piston 22 blocked by the magnet 67. A pump pressure of 170 bar is built up which acts on the piston of the cylinder 16 and drops, via the metering diaphragm 13, to 150 bar in the section 64 of the channel 25 and, via the pressure compensator 19, to the load pressure of the consumer 15 in the section 33 of the channel 25.

On the other hand, if the load pressure of the first hydraulic consumer 15 is higher than the pressure set on the pressure-reduction valve 65, the pressure compensator 19 opens completely, so that the higher load pressure of the first consumer is signaled into the load-signaling line 28. The pressure-reduction valve 65 is not able to influence this pressure so that a pump pressure lying 20 bars above the load pressure of the consumer 15 is established in the pressure line 12. Aside from the consumers 15 and 16, other hydraulic consumers can also be actuated, in which case a pressure of 150 bar or a higher load pressure of the consumer 15 or of the other hydraulic consumers prevails in the load-signaling line 28.

Figure 3:
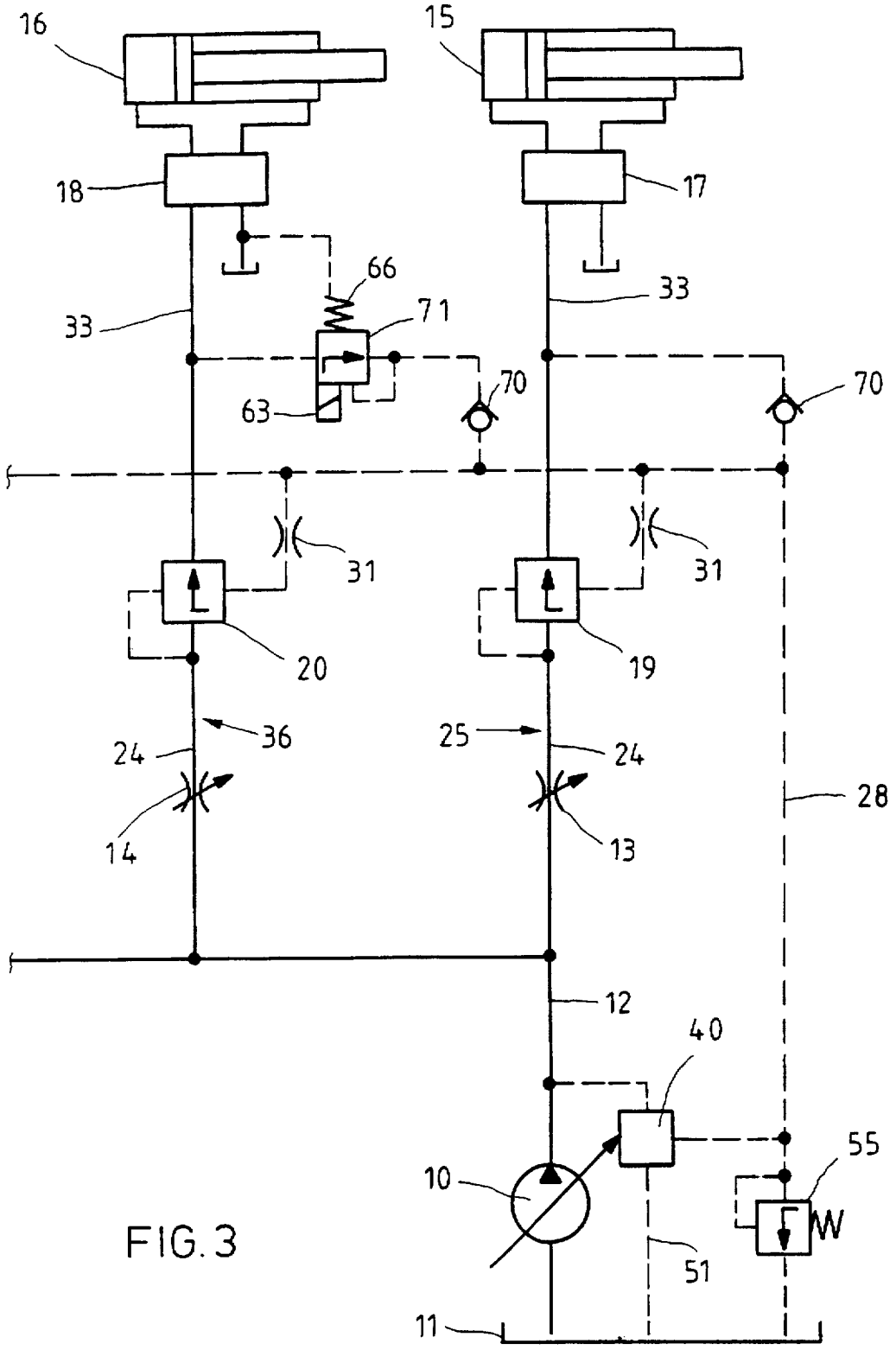
FIG. 3 shows a third control arrangement which also comprises a pressure-reduction valve which, however, is arranged in series with a load-signaling valve.

The control arrangement of FIG. 3 differs essentially in three points from the control arrangement of FIG. 2. On the one hand, the highest load pressure is not signaled into the load-signaling line 28 via the pressure compensator associated with the consumer with the highest load but via a return valve 70 which opens towards the load-signaling line 28. Each return valve 70 of the individual consumers, with the exception of the second consumer 16, is connected directly to the line section 33 between the corresponding pressure compensator and the directional part 17. The second difference from the embodiment of FIG. 2 is that a pressure-reduction valve 71 is present only in series with the return valve 70 associated with the secon d hydraulic consumer 16. Thirdly, an electromagnet 63 acts, together with the pressure at the output of the pressure-reduction valve 71, on a movable valve body of the valve in closing direction against a strong compression spring 66 acting in opening direction. The compressio n spring 66 is so strong that the pressure-reduction valve 71 is opened under the operating pressures which occur when the electromagnet 63 is disconnected.

The control arrangement of FIG. 3 with the electromagnet 63 disconnected therefore functions in the normal manner which has already been indicated above. If the pressure-reduction valve 71, however, is now set to an initial output pressure of for instance 150 bar, after the actuation of the electromagnet 63, this pressure of 150 bar is signaled into the load-signaling line 28 provided that the highest load pressure of all other consumers actuated is less than 150 bar. The pump pressure is then 170 bar, which acts on the piston of the cylinder 16 and produces a given clamping force. If the highest load pressure of the other hydraulic consumers actuated is higher than 150 bar, then the load-signaling line 28 is acted on by this highest load pressure and the pump pressure is 20 bar above this highest load pressure.

If the time during which the control arrangement of FIG. 3 is operated in the manner last described should be longer than the time of so-called normal operation, the electromagnet 63 will be permitted to act in the opening direction of the valve 71 and the limiting pressure of, for instance, 150 bar will be established by a corresponding pretensioning of the compression spring 66. Upon the connecting of the electromagnet 63, the valve 71 is then open at all operating pressures.

Figure 5:
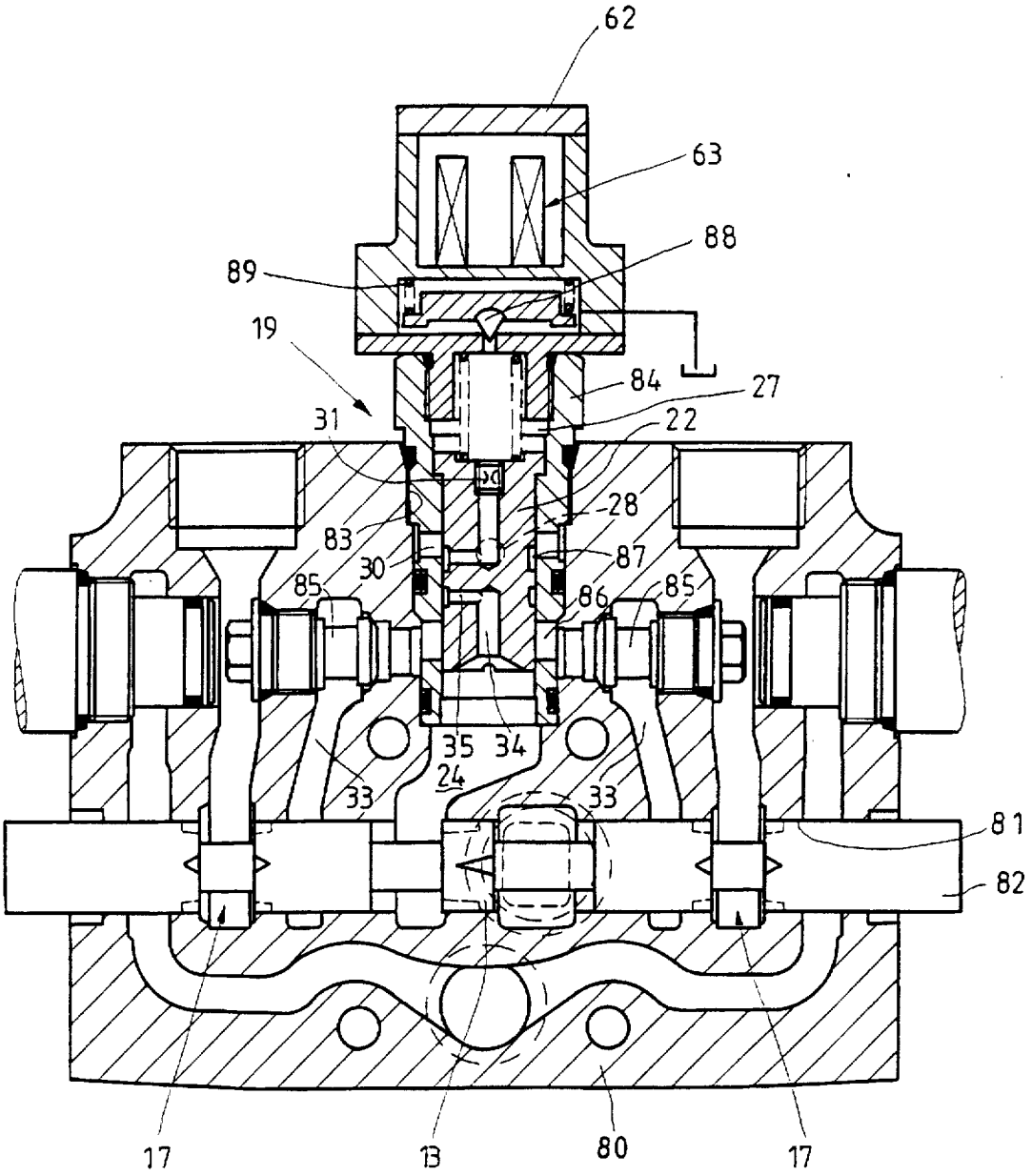
FIG. 5 is a section through a segment of a directional control valve, such as can be used in a control arrangement according to FIGS. 1 to 3, in which connection, in accordance with the embodiment shown in FIG. 1, an electromagnetically displaceable pressure-limiting valve can, in addition, be provided.

The proportional-directional-control valve segment of FIG. 5 is provided in a housing 80 with a valve bore hole 81 in which a control piston 82 is axially displaceable. This control piston has at its center a metering-diaphragm part 13, 14 and, on both sides of the metering-diaphragm part, in each case half of a directional part 17.

In a stepped bore hole 83 which is aligned vertically with the bore hole 81 there is inserted a pressure compensator 19 which contains a regulating piston 22 in a sleeve 84 having the aforementioned bore holes 30. Between the pressure compensator and the metering throttle there is the channel section 24 and between the pressure compensator 15 and the halves of the directional part 17 there is in each case a part of the channel section 33, a load-retaining valve 85 being present in each part. A connection between the channel sections 24 and 33 can be produced via several radial bore holes 86 in the sleeve 84. The bore holes 30 extend outwards from an annular space between the sleeve 84 and the wall of the bore hole 83 into which annular space the load-signaling channel 28, indicated in dashed line, also debouches twice. This load-signaling channel 28 is connected at all times to the rear pressure space 27 via an outer groove 87 of the regulating piston 22 and via a radial bore hole and an axial hole as well as via a nozzle 31 arranged in said axial bore hole. With the pressure compensator entirely open there is furthermore a connection through the regulating piston 22 between the line section 24 and the bore holes 30. For this, the regulating piston has another axial bore hole 34, another radial bore hole and another annular groove. The radial bore hole can in this connection be considered a nozzle 35.

A pressure-limiting valve 62 by which the pressure in the pressure space 27 can be limited to a given pressure is screwed, by a threaded attachment into the sleeve 84, closing the pressure space 27. With the electromagnet 63 connected, the magnetic force acts in the opening direction of the valve 62 together with the force produced by the pressure in the pressure space 27 on a valve body 88. A strong compression spring 89 acts in closing direction of the valve 62. The armature of the electromagnet 63 is a flat armature which is developed integral with the valve body 88.

We claim:

1. A control system for a plurality of hydraulic consumers comprising:

a variable displacement pump having a displacement which is adjustable by a load-sensing regulator, said load-sensing regulator being selectively connected with a load pressure by a load-signaling line, wherein said load-sensing regulator includes a maximum pressure control and a power control; a first and a second adjustable metering throttle, the first metering throttle being connected between the variable displacement pump and a first of the hydraulic consumers, the second metering throttle being connected between the variable displacement pump and a second of the hydraulic consumers;

a first and a second pressure compensator, the first pressure compensator being connected behind the first metering throttle, and the second pressure compensator being connected behind the second metering throttle;

wherein each of the pressure compensators has a regulating piston, the piston of each of a respective one of the pressure compensators being acted on, via a front side thereof, by pressure behind the corresponding metering throttle in an opening direction, and on a rear side of the piston by pressure in the load-signaling line in a closing direction, a pressure valve connected with one of said first and said second consumers, and being switchable between an active and an inactive state, and when in its active state defines a limit pressure lying below a maximum pressure; the load sensing regulator is acted on by a pressure which is dependent on a load pressure of the first hydraulic consumer when the load pressure of the first hydraulic consumer is greater than the limit pressure and said pressure valve is in its active state; and the load sensing regulator is acted on by a pressure which is dependent on the limit pressure when the load pressure of the first hydraulic consumer is less than the limit pressure and said pressure valve is in its active state.

2. A control system according to claim 1, wherein in the case of individual actuation of the second hydraulic consumer (16) the load-sensing regulator (41) is acted on by the load pressure of the second consumer (16) only when the load pressure of the second consumer is above the limiting pressure, when said pressure valve is in its active state.

3. A control system according to claim 2, wherein the plurality of consumers includes a third hydraulic consumer, a third metering throttle, and a third pressure compensator, with the third pressure compensator and the third metering throttle connected serially between the pump and the third consumer and the third compensator being located between the third metering throttle and the third consumer for the supplying of pressurized fluid by the pump to the third consumer;

in the case ofjoint activation of the first, second and third hydraulic consumer; the load-sensing regulator (41) is acted on by the higher of the two load pressures of the first and third hydraulic consumers, when the load pressures of the first and third hydraulic consumers are greater than the limit pressure and said pressure valve is in its active state.

4. A control system according to claim 1, wherein:

the plurality of consumers includes a third hydraulic consumer, and the system comprises a third metering throttle, a third pressure compensator, and a load-sensing regulator;

in a condition of joint activation of the plurality of hydraulic consumers with a supplying of the consumers with pressurized fluid by the positive displacement pump, the third pressure compensator and the third metering throttle are connected serially between the pump and the third consumer with the third compensator being located between the metering valve and the third consumer for the supplying of the pressurized fluid by the pump to the third consumer; and the pressure valve is in its active state and both the load pressure of the first consumer and the load pressure of the third consumer are higher than the limit pressure, the load-sensing regulator being acted on by a higher of load pressures of the first consumer and third consumer.

5. A control system according to claim 1, wherein the load-sensing regulator (41) is acted on by differing values of pressure as a function of the state of the pressure valve (60, 62, 65, 71).

6. A control system according to claim 5, further comprising an electromagnet, and wherein the pressure valve (60, 62, 65, 71) is displaceable by operation of the electromagnet as a function of different actuations of the hydraulic consumers (15, 16).

7. A system according to claim 1, wherein:

each of said pressure compensators has a rear pressurized space and a rear throttle disposed in the piston and opening via the rear side of the piston into the rear pressurized space;

the load-signaling line is connected via the regulating piston of the first pressure compensator to a section of a first consumer line between the first consumer and the first metering throttle to be responsive to load pressure of the first consumer;

the regulating piston of the first compensator is acted on by pressure in the rear pressurized space moving the regulating piston in a closing direction, the pressure from the rear pressurized space is selectively communicated, via the rear throttle, with the load signaling line; and wherein the pressure valve is a pressure limiting valves which in the active state, limits the pressure of the rear pressurized space to the limiting pressure lying below the maximum pressure.

8. A control system according to claim 7, wherein load-signaling valves are incorporated into the pressure compensators (19, 20) enabling the load-signaling line (28) to receive a higher load pressure via the piston (22) of the pressure compensator (19, 20) which is associated with the hydraulic consumer (15, 16) having the higher load pressure.

9. A control system according to claim 8, wherein each load-signaling valve is incorporated into the piston (22) of an associated pressure compensator (19, 20).

10. A control system for a plurality of hydraulic consumers comprising:

a variable displacement pump having a displacement which is adjustable by a load-sensing regulator, said load-sensing regulator being selectively connected with a load pressure by a load-signaling line, wherein said load-sensing regulator includes a maximum pressure control and a power control;

a first and a second adjustable metering throttle, the first metering throttle being connected between the variable displacement pump and a first of the hydraulic consumers, the second metering throttle being connected between the variable displacement pump and a second of the hydraulic consumers;

a first and a second pressure compensator, the first pressure compensator being connected behind the first metering throttle, and the second pressure compensator being connected behind the second metering throttle;

wherein each of the pressure compensators has a regulating piston, the piston of each of a respective one of the pressure compensators being acted on, via a front side thereof, by pressure behind the corresponding metering throttle in an opening direction and on a rear side of the piston by pressure in the load-signaling line in a closing direction;

a pressure valve being switchable between an active and an inactive state, and when in its active state, setting a limit pressure lying below a maximum pressure.

the load-sensing regulator, upon joint actuation of the first and the second hydraulic consumers is acted on by a pressure which is dependent only on a load pressure of the first hydraulic consumer when the load pressure of the first hydraulic consumer is greater than the limit pressure; and the load sensing regulator is acted on by differing values of pressure as a function of the state of the pressure valve.

11. A control system according to claim 10, further comprising an on-off valve connected between the pressure valve and the first compensator, and wherein the pressure valve (61) has a fixed setting and is switched between active and inactive states by the switching of he on-off valve (60).

12. A control system according to claim 10, wherein the pressure valve (62, 65, 71) is displaceable by an electromagnet (63).

13. A control system according to claim 12, wherein the pressure set on the pressure valve (62, 65, 71) is lower upon the passage of electric current through the electromagnet (63) than in the absence of current flow through the electromagnet.

14. A control system according to claim 10, wherein the pressure valve (60, 62, 65, 71) is displaceable as a function of different actuations of the hydraulic consumers (15, 16).

15. A control system according to claim 14, further comprising an on-off valve in series with the first compensator, and wherein the pressure valve (61) has a fixed setting and is switched between active and inactive states by the switching of the on-off valve (60).

16. A control system according to claim 14, wherein the pressure valve (62, 65, 71) is displaceable by an electromagnet (63).

17. A control system according to claim 16, wherein the pressure set on the pressure valve (62, 65, 71) is lower upon the passage of current through the electromagnet (63) than in the absence of current flow through the electromagnet.

18. A control system for a plurality of hydraulic consumers comprising:

a variable displacement pump having a displacement which is adjustable by a load-sensing regulator, said load-sensing regulator being selectively connected with a load pressure by a load-signaling line, wherein said load-sensing regulator includes a maximum pressure control and a power control;

a first and a second adjustable metering throttle, the first metering throttle being connected between the variable displacement pump and a first of the hydraulic consumers, the second metering throttle being connected between the variable displacement pump and a second of the hydraulic consumers;

a first and a second pressure compensator, the first pressure compensator being connected behind the first metering throttle, and the second pressure compensator being connected behind the second metering throttle;

wherein each of the pressure compensators has a regulating piston, the piston of each of a respective one of the pressure compensators being acted on, via a front side thereof, by pressure behind the corresponding metering throttle in an opening direction, and on a rear side of the piston by pressure in the load-signaling line in a closing direction;

a pressure valve connected between the load-signaling line (28) and a second consumer line connecting the pump (12, 36) to the second hydraulic consumer (16), and setting a limit pressure lying below a maximum pressure;

the load-sensing regulator, upon joint actuation of the first and the second hydraulic consumers is acted on by a pressure which is dependent only on a load pressure of the first hydraulic consumer when the load pressure of the first hydraulic consumer is greater than the limit pressure.

19. A control system according to claim 18 further comprising a load-signaling valve connected in series with the pressure valve;

the load-signaling valve has a movable valve body which is acted on in closing direction by pressure in the load-signaling line and in opening direction by an output of the pressure valve; and that the pressure valve is a pressure reduction valve.

20. A control system according to claim 18, wherein there is a parallel connection connected in parallel with the pressure valve (65) via a load-signaling valve (20), wherein this parallel connection is selectively closed.

21. A control system according to claim 20, wherein the load-signaling valve (20) of the second compensator has a movable valve body (22) which is selectively moved to a closed position.

22. A control system according to claim 21, wherein the pressure valve (65) is connected to a portion of the second consumer line (12) which is between the variable displacement pump (10) and the metering throttle (14).

23. A control system according to claim 20, wherein the pressure valve (65) is connected to a portion of the second consumer line (12) which is between the variable displacement pump (10) and the metering throttle (14).

24. A control system for a plurality of hydraulic consumers comprising:

a variable displacement pump having a displacement which is adjustable by a load-sensing regulator, said load-sensing regulator being selectively connected with a load pressure by a load-signaling line, wherein said load-sensing regulator includes a maximum pressure control and a power control;

a first and a second adjustable metering throttle, the first metering throttle being connected between the variable displacement pump and a first of the hydraulic consumers, the second metering throttle being connected between the variable displacement pump and a second of the hydraulic consumers;

a first and a second pressure compensator, the first pressure compensator being connected behind the first metering throttle, and the second pressure compensator being connected behind the second metering throttle;

wherein each of the pressure compensators has a regulating piston, the piston of each of a respective one of the pressure compensators being acted on, via a front side thereof, by pressure behind the corresponding metering throttle in an opening direction, and on a rear side of the piston by pressure in the load-signaling line in a closing direction;

a pressure valve connected with one of said first and said second consumers, and being switchable between an active and an inactive state, and when in its active state, defines a limit pressure lying below a maximum pressure;

wherein in the active state of the pressure valve and upon joint activation of only the first and second hydraulic consumers, the load sensing regulator is acted on by a pressure which is dependent on a load pressure of the first hydraulic consumer when the load pressure of the first hydraulic consumer is greater than the limit pressure and said pressure valve is in its active state;

and the load sensing regulator is acted on by a pressure which is dependent on the limit pressure when the load pressure of the first hydraulic consumer is less than the limit pressure and said pressure valve is in its active state.

25. A control system for a plurality of hydraulic consumers comprising: a variable displacement pump having a displacement which is adjustable by a load-sensing regulator, said load-sensing regulator being selectively connected with a load pressure by a load-signaling line, wherein said load-sensing regulator includes a maximum pressure control and a power control;

a first and a second adjustable metering throttle, the first metering throttle being connected between the variable displacement pump and a first of the hydraulic consumers, the second metering throttle being connected between the variable displacement pump and a second of the hydraulic consumers;

a first and a second pressure compensator, the first pressure compensator being connected behind the first metering throttle, and the second pressure compensator being connected behind the second metering throttle;

wherein each of the pressure compensators has a regulating piston, the piston of each of a respective one of the pressure compensators being acted on, via a front side thereof, by pressure behind the corresponding metering throttle in an opening direction, and on a rear side of the piston by pressure in the load-signaling line in a closing direction;

a pressure valve being switchable between an active and an inactive state, and when in its active state, defines a limit pressure lying below a maximum pressure;

wherein in the active state of the pressure valve and upon joint activation of only the first and second hydraulic consumers, the load sensing regulator is acted on by a pressure which is dependent on a load pressure of the first hydraulic consumer when the load pressure of the first hydraulic consumer is greater than the limit pressure and said pressure valve is in its active state;

and the load sensing regulator is acted on by a pressure which is dependent on the limit pressure when the load pressure of the first hydraulic consumer is less than the limit pressure and said pressure valve is in its active state.

* * * * *